US006234433B1

(12) United States Patent
Maglione

(10) Patent No.: US 6,234,433 B1
(45) Date of Patent: May 22, 2001

(54) DISPLAY TRAY WITH COLLAPSIBLE RELEASABLE SUPPORT

(76) Inventor: Stephen Thomas Maglione, 71 Baltusrol Way, Far Hills, NJ (US) 07931

( * ) Notice: Subject to any disclaimer, the term of this patent is extended or adjusted under 35 U.S.C. 154(b) by 0 days.

(21) Appl. No.: 09/236,527

(22) Filed: Jan. 25, 1999

(51) Int. Cl.[7] ..... A45D 19/04; A47J 47/16; F16M 11/00; A47G 23/02; A47F 5/12

(52) U.S. Cl. ..... 248/174; 248/152; 248/135

(58) Field of Search ..... 248/174, 152; 211/135, 72, 73, 126.16, 132.1

(56) References Cited

U.S. PATENT DOCUMENTS

| | | | | |
|---|---|---|---|---|
| 3,433,365 | | 3/1969 | Hodson . | |
| 3,836,104 | * | 9/1974 | Miller et al. | 248/174 |
| 3,871,608 | | 3/1975 | Ogden . | |
| 4,253,777 | * | 3/1981 | Pillifant, Jr. | 248/150 |
| 4,671,417 | | 6/1987 | O'Brien . | |
| 4,773,173 | * | 9/1988 | Christian | 248/174 |
| 5,542,551 | * | 8/1996 | Smith | 248/174 |
| 5,558,921 | * | 9/1996 | Pavlik | 248/174 |
| 5,620,104 | | 4/1997 | Maglione . | |
| 5,868,367 | * | 2/1999 | Smith | 248/174 |

* cited by examiner

*Primary Examiner*—Ramon O. Ramirez
*Assistant Examiner*—J DeLuca

(57) ABSTRACT

A point of sale display stand includes a peg type article display and a display support that has a collapsible state and a deployed state. The support comprises two triangular sidewalls with medial foldlines and spaced upper and lower rear walls connected by foldlines to the sidewalls. A flat sheet material brace is attached to the lowermost support rear wall by a foldline. An elastomeric member is connected to the brace and display rear wall. The brace and support rear and sidewalls fold in overlying relation in a collapsed state stretching the elastomeric member creating a potential energy tensile load therein. Initial lifting the support lowermost rear wall in the deployment direction automatically snap releases the brace to a deployed locked state deploying the support walls such that the support is in position to support the article display.

19 Claims, 9 Drawing Sheets

DISPLAY TRAY WITH COLLAPSIBLE RELEASABLE SUPPORT

This invention relates to supports for article display stands, more particularly to supports for paperboard peg type displays for supporting the display in a display orientation.

Of interest are commonly owned U.S. Pat. Nos. 5,762,207 and 5,620,104 incorporated by reference herein.

Display stands employing corrugated paperboard are in wide use. The stands have numerous configurations established for particular point of sale display of articles. Generally, such stands have a display portion and a support for retaining the display portion upright or inclined in a display orientation. See for example the aforementioned US patents. Stands may have shelves or they may have a display panel from which pegs extend for hanging articles for display. For example, see the aforementioned patents and U.S. Pat. Nos. 3,871,608, 4,671,417 and 3,433,365 for peg type displays all incorporated by reference herein.

These displays are counter type units which are relatively small, light and easy to assemble. Other displays are floor mounted and typically have large boxes and the like for supporting a display member. Many are collapsible type displays and require, in some cases, relatively complex assembly of the various components. Because they are generally paperboard, the interconnections of the components tend to be difficult at times and sometimes the connections may become damaged during assembly affecting the connection of the various components. Typically such displays need to be first assembled prior to placement into use at the point of sale location This can be time consuming for the personnel involved and is not always conducive to proper assembly and thus can lead to an unattractive display.

The present inventor recognizes a need for a point of sale display that can be readily assembled quickly and without possible damage to the interrelated connections. In particular, a need is recognized for a display support that is readily adaptable to conventional displays but needs no mechanical assembly of the components. The support can be readily deployed from a portable configuration to a display configuration with no or a minimum of such component assembly.

A collapsible display stand according to the present invention comprises an article display tray for receiving articles to be displayed; the tray having a bottom wall, a pair of opposing side walls and an end wall extending from the bottom wall, the tray having spaced slots in the bottom wall adjacent to the opposing side walls. A collapsible display member support has at least one rear wall with opposing first edges, opposing spaced first and second side walls each hinged to the rear wall at a different one of the rear wall opposing first edges, the first and second side walls each having a medial first hinge and a second edge distal the first hinge and distal the at least one rear wall such that the first and second side walls can each selectively collapse against the at least one rear wall. At least one tab extends from each of the first and second side walls at the second edge thereof the at least one tab being received in a different slot in the tray to releasably secure the support to the tray whereby in the collapsed state the at least one rear wall and first and second side walls are juxtaposed with at least a portion of the tray bottom wall and in the extended state the tray cooperates with the support to form a four wall support structure with the bottom wall to thereby form a self supporting display stand.

In one aspect, a brace is included having a collapsed state and a deployed state, the brace being hinged to the at least one rear wall and shaped and sized to abut the opposing first and second support side walls and tray bottom wall in the deployed state to stiffen the deployed side walls, the medial first hinge forming each of the first and second side walls into first and second sections, the collapsed sections of the first and second side walls each folding relative to each other at the respective medial first hinge, the collapsed sections of a side wall and the brace being juxtaposed with the at least one rear wall and tray bottom wall in the collapsed state.

In a further aspect, the support first and second side walls, tabs, at least one rear wall and brace are one piece paperboard.

In a further aspect, the at least one rear wall has a finger receiving opening for permitting the support to be manually deployed from the collapsed state.

In a further aspect, biasmeans are secured to the brace and tray bottom wall for biasing the brace to the deployed state.

In a still further aspect, the at least one rear wall comprises two spaced rear walls and wherein the brace is secured to one of the two rear walls, the brace in the collapse state being positioned between and coplanar with the two spaced rear walls, the brace, rear walls, first and second side walls and tabs being one piece paper board.

In a further aspect, the tray side walls and tray bottom wall each have a support edge, the support first and second side walls and at least one rear wall each having a further edge that is coplanar with the tray support edges and define a support plane for the tray and support.

In a further embodiment, the at least one rear wall has a finger receiving opening for permitting the support to be manually deployed from the collapsed state.

In a further embodiment, the support comprises sheet material with at least one rear wall and two opposing side walls, each side wall including a first hinge for dividing the corresponding side wall into first and second sections which fold in overlying relation in table collapsed state, a brace member hinged to the at least one rear wall with a second hinge, the brace member having a collapsed state juxtaposed with the at least one rear wall and a deployed state transverse the rear wall abutting the tray display unit for locking the side walls in an extended unfolded condition, and bias means for causing the brace member and side walls to automatically extend to the deployed state upon partial displacement of the rear wall from the collapsed state to the deployed state.

In a further embodiment, the at least one rear wall comprises two spaced rear walls with the brace member hinged to one of the rear walls.

Preferably, the support side walls and brace are one piece with the rear wall, the side walls each having a medial fold line forming the first hinge, a fold line between the brace member and at least one rear wall normal to the side walls and forming the second hinge.

The bias means preferably includes an elastic member having a bias force insufficient to deploy a fully collapsed support and sufficient to automatically fully deploy the support when the support is partially manually deployed.

The deployment means preferably includes elastomeric bias means for resiliently biasing the support into the deployed state.

In a further embodiment, the support side walls are mirror image triangular members one piece with the rear wall and having a medial fold line forming the first hinge, the brace member comprising a sheet material integral and one piece with the rear wall, a fold line between the brace member and support normal to the side walls and forming the second hinge.

The bias means preferably comprises an elongated elastomeric member.

The display stand in a further embodiment includes means for retaining the support collapsed such that removal of the retaining means permits the support to deploy automatically.

The retaining means may comprise a clip, a cord wrapped about the collapsed support or an elastic band about the collapsed support.

IN THE DRAWING

Figure 1:
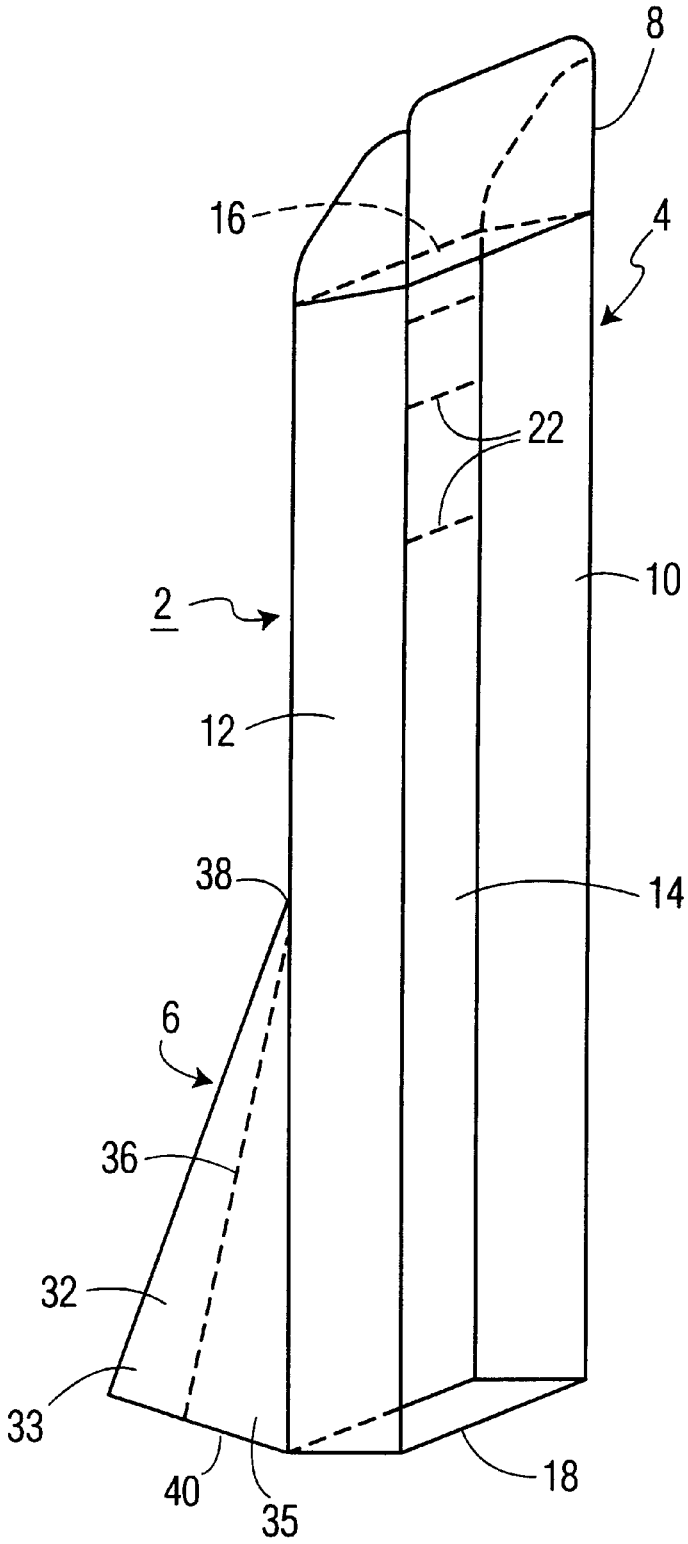
FIG. 1 is an isometric frontal view of a display stand according to an embodiment of the present invention.
Figure 6A:
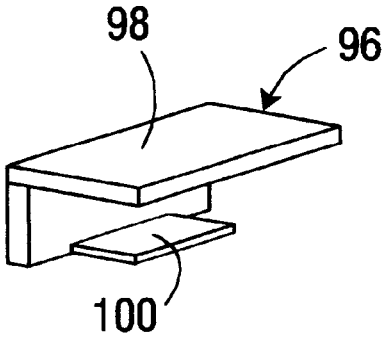
FIG. 6 is a fragmented isometric view of the collapsed support portion of the stand of the present invention.
Figure 6B:
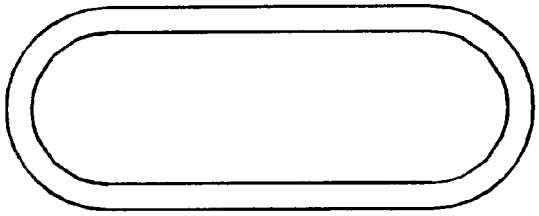
Figure 6:
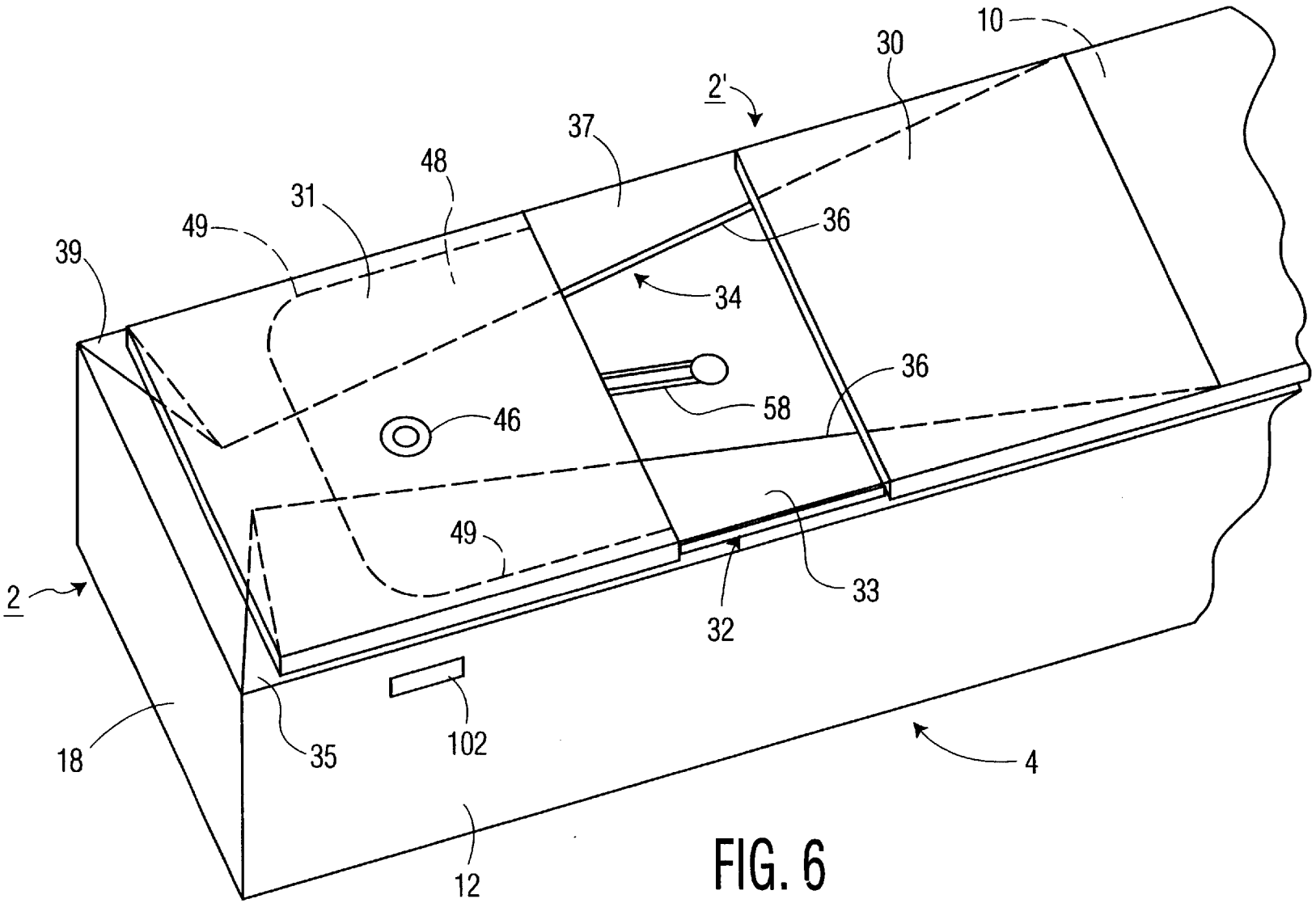
Figure 7:
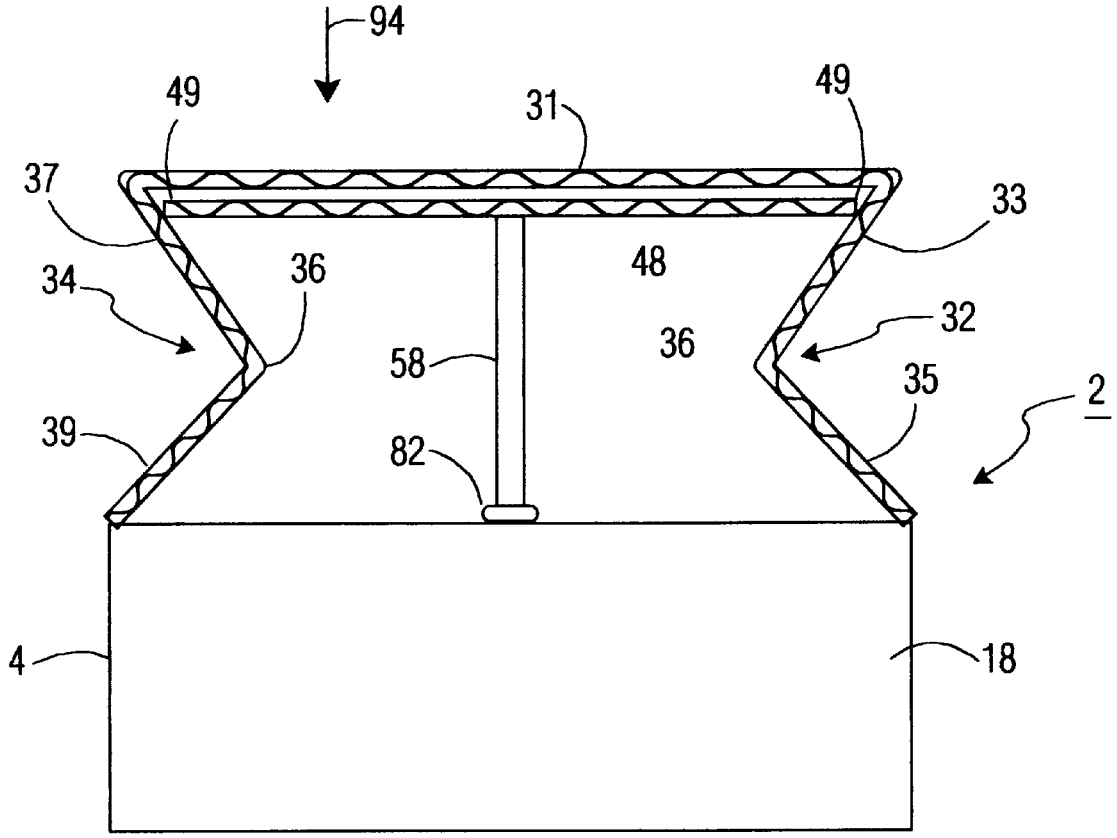
Figure 8:
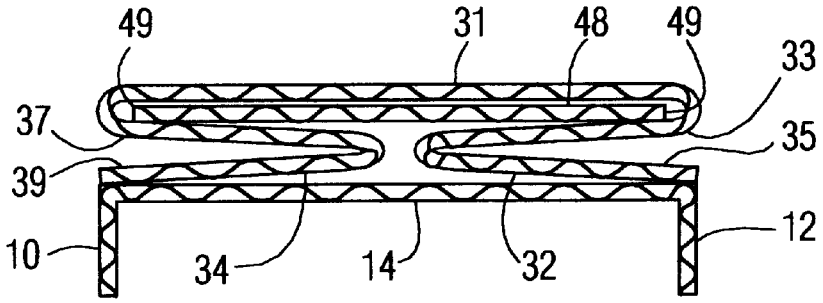
Figure 9:
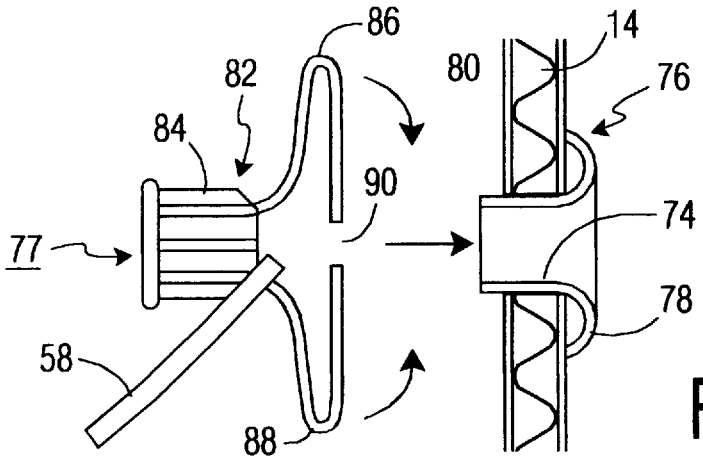
Figure 10:
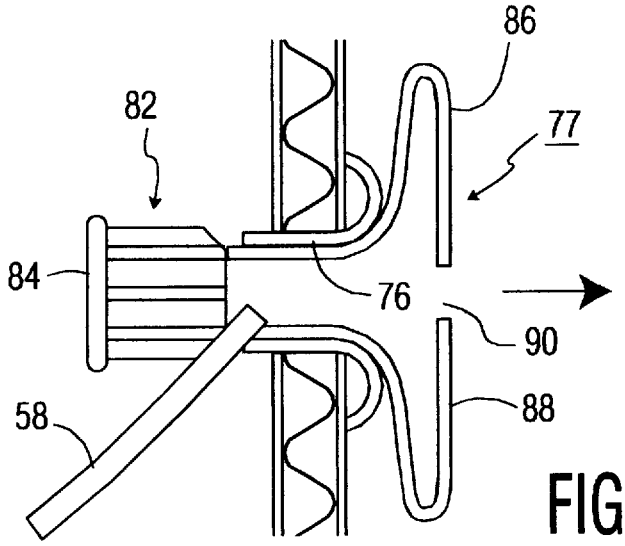
Figure 11:
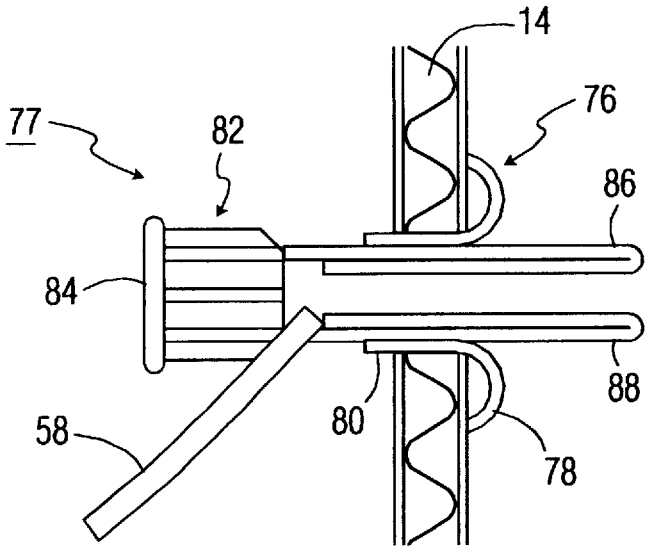
Figure 12:
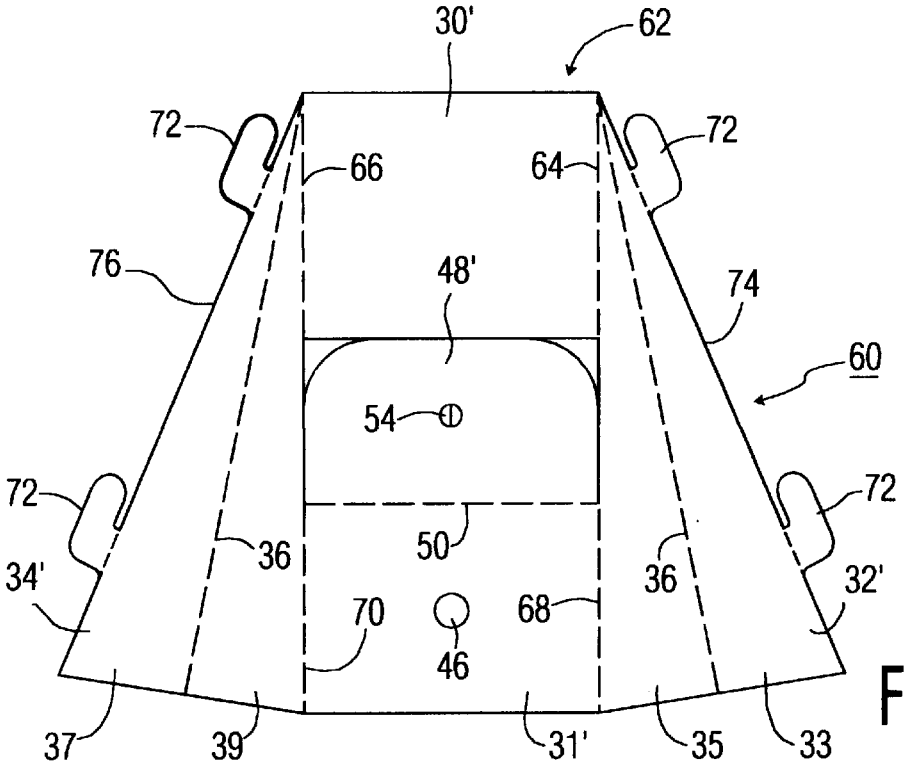
Figure 13:
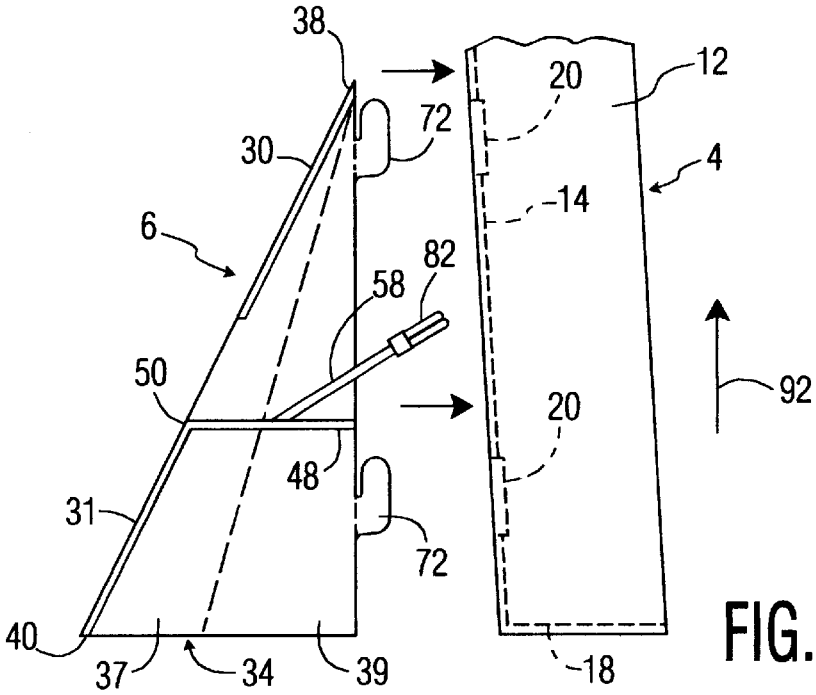
Figure 14:
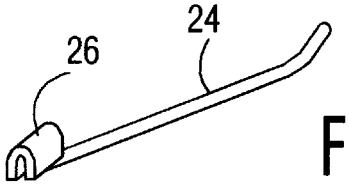

FIG. 6*a* is an isometric view of a clip which may be used to hold the collapsed portion of FIG. 6 collapsed;

FIG. 6*b* is an elevation view of an elastic band which in the alternative may be used to hold the collapsed portion of FIG. 6 collapsed;

FIG. 7 is an end view of the display of the present invention showing partial deployment of the support;

FIG. 8 is an end sectional view of the display of the present invention showing the collapsed state of the support;

FIGS. 9–11 are elevation sectional views showing various stages of assembling an elastic support biasing member to the display;

FIG. 12 is a top plan view of a blank forming the support of the display stand of FIG. 1;

FIG. 13 is an exploded side elevation view of the stand of FIG. 1 during assembling of the support to the display portion of the stand; and FIG. 14 is an isometric view of a representative peg hook for use in the display of FIG. 1.

In FIGS. 1–4, display stand 2 comprises a display 4 and a collapsible automatically deployable support 6. A decorative cap 8 is secured on the top of the display 4. The display 4, support 6 and cap 8 are all preferably formed of sheet single ply corrugated paperboard. Other materials such as pressed paperboard, cardboard or non-paper materials may be used according to a given implementation.

Display 4 comprises a single one piece sheet of paperboard that is folded at fold lines to form mirror image sidewalls 10 and 12, rear display wall 14 and mirror image respective top and bottom walls 16 and 18. The sidewalls 10 and 12 and top and bottom walls 16 and 18 are formed by folding over the sheet material to form a double layer of sheet material. The side, top and bottom walls include conventional tabs (not shown) engaged with slots 20 in the rear wall at the rear wall edges for locking the walls normal to the rear wall in conventional fashion. The end walls are formed with tabs (not shown) that engage slots formed by the doubled over sidewalls. The display 4 thus takes the shape of an elongated box with an open front. In the alternative, the display may comprise a planar wall with no top, bottom or sidewalls.

The rear wall 14 is formed with a plurality of slots 22 for receiving a peg 24, FIG. 14. Peg 24 has a hook 26 at one end for engaging the rear wall 14 at a slot 22. Similar peg type arrangements are disclosed in the aforementioned patents incorporated by reference herein.

The cap 8 is a single ply of paperboard folded at fold lines and attached to slots in the top of the display 4 at slots such as slots 20 with tabs 28. The cap is not essential and does not form a part of the present invention.

The collapsible support 6 comprises a single ply of sheet corrugated paperboard and has an upper rear wall 30 and a lower rear wall 31 spaced from the upper rear wall. The support includes two triangular sidewalls 32 and 34. A fold line 36 forming a hinge is in each sidewall 32 and 34 extending from each sidewall apex 38 to a support edge 40 at the bottom of the support 6. The fold lines are shown as dashed lines. The sidewalls 34 and 36 are respectively folded to the rear walls 30 and 31 at fold lines 42, 42' and 44, 44' which form hinges between the sidewalls and the support rear walls 30 and 31. The sidewalls are normal to the rear walls 30 and 31. All of the walls are generally flat.

Figure 5:
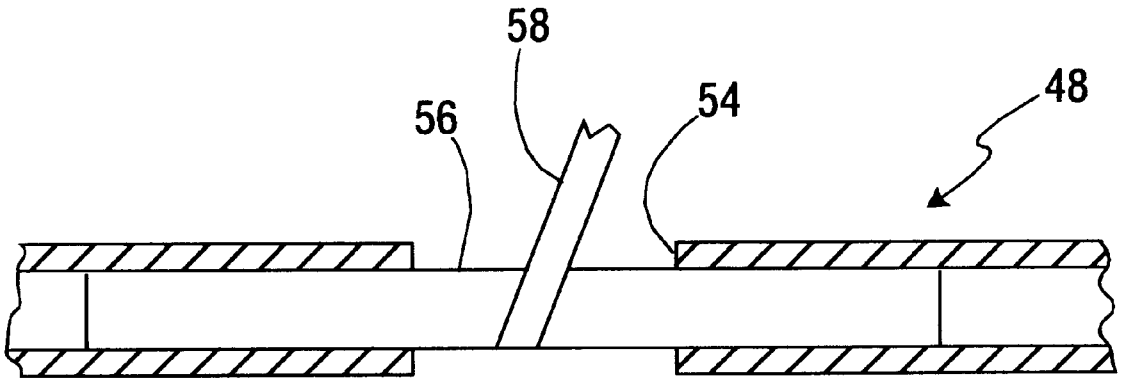
FIG. 5 is a more detailed sectional view of the region 5 in FIG. 4.

A circular hole 46 is in lower rear wall 31. A brace 48 is integral and one piece with the support rear wall 31 at fold line 50 forming a hinge for the brace. The brace 48 comprises a flat rectangular in plan view sheet member with rounded corners 52. As best seen in FIG. 5, the brace 48 has a circular hole 54 and a flute pin 56 which spans the hole 54 and is located within the flutes of the corrugated sheet forming the brace 48. An elastic band 58 is secured to the pin 56 in hole 54. The pin 56 and hole 54 are generally centrally located in the brace 48.

In FIG. 12, a blank 60 forms the support 6. The blank 60 has a rectangular center section 62 formed with sections 30' and 31' which form the rear walls 30 and 31, respectively. Section 48' forms the brace 48 and is connected to section 31' by fold line 50. Triangular sections 32' and 34' form sidewalls 32 and 34 respectively. Section 30' is connected to section 32' by fold line 64 and to section 34' by fold line 66. Section 32' is connected to section 31' by foldline 68 and section 34' is connected to section 31' by foldline 70. Hook shaped tabs 72 extend from the edges 74 and 76 of respective sections 32' and 34'. The sections correspond to the same elements of the support 6 with the same reference numerals but without the primes. The tabs 72 are inserted into and lock to the display 4 via slots 20' in the display, FIG. 2.

The foldlines 36 in the sidewalls 32 and 34 divide the sidewalls into triangular sections. Wall 32 is divided into sections 33 and 35 and wall 34 is divided into sections 37 and 39, FIGS. 2 and 4. With the tabs 72 so inserted the sidewalls 32 and 34 of the support 6 are coextensive with the sidewalls 12 and 10, respectively, of the display 4.

In FIG. 9, display 4 rear wall 14 has a hole 74. A connection assembly 77 connects the band 58 to the display 4 rear wall 14. The assembly 77 includes a conventional circular metal grommet 76 that has a flange 78 and a shank 80. The shank 80 is inserted into the wall 14 hole 74 and extends beyond the rear of the rear wall 14. The assembly 77 also includes a wing connector 82 which has a fluted head 84 and a pair of wings 86, 88 interconnected as a single loop. A slit 90 separates the wings 86 and 88. Without the slit 90, the connector 82 is conventional. The slit 90 permits the elastic band 58 to be inserted inside the loop of the wings 86 and 88 as shown. The slit 90 is optional.

In FIG. 11, the wings 86 and 88 are bent together and inserted through the hollow core of the grommet shank 80. The wings are inserted completely through the grommet until they can be spread apart to the original condition of FIG. 9, FIG. 10. This lock's the assembly 77 to the wall 14 and the other end of the band 58 distal the brace 48, FIG. 4, to the display 4 rear wall 14.

Figure 2:
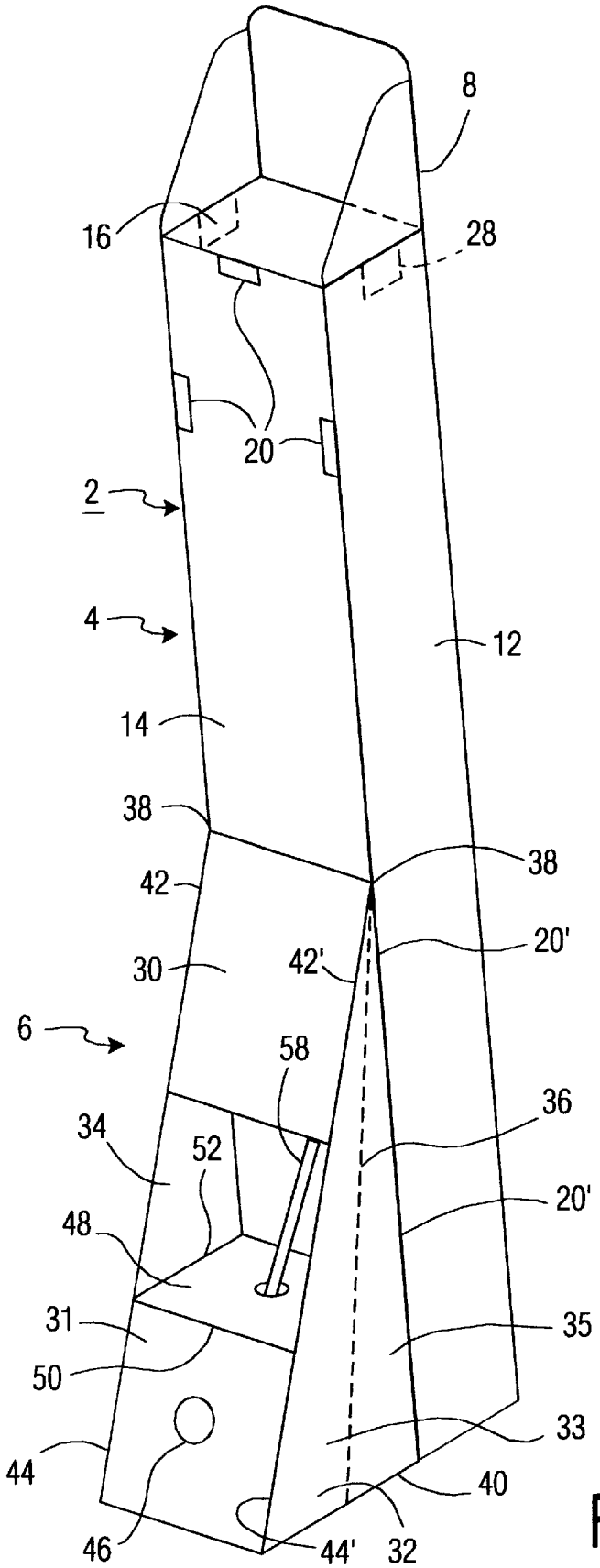
FIG. 2 is an isometric rear view of a display stand of the embodiment of FIG. 1.
Figure 3:
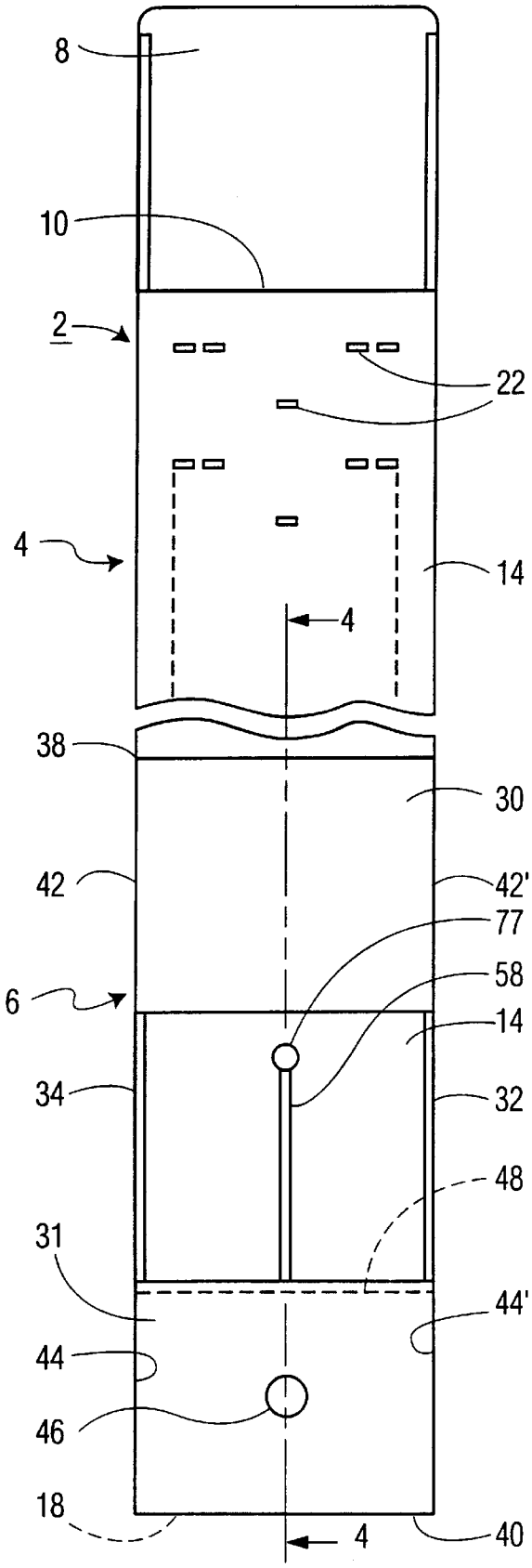
FIG. 3 is a rear elevation view of the stand of FIG. 1.

In FIG. 13, the support 6 is opened to the deployed state shown with the brace 48 folded over at foldline 50 parallel to the edge 40. The tabs 72 are inserted into the slots 20 in the display 4. The support 6 is then displaced upwardly direction 92 to lock it to the display 4. The assembly looks as shown in FIGS. 1–3.

Figure 4:
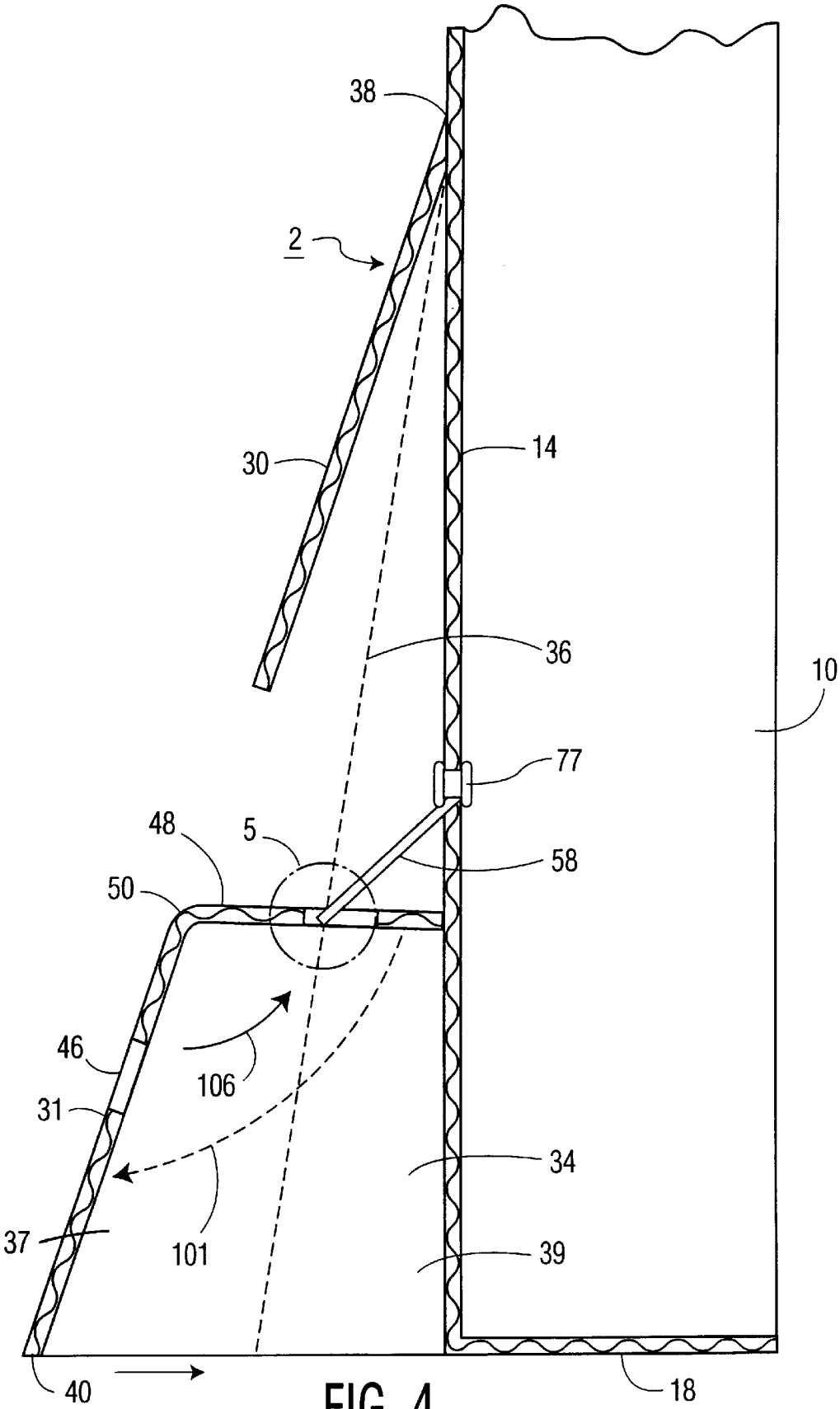
FIG. 4 is a sectional elevation view of the embodiment of FIG. 3 taken along lines 4—4.

In operation, to collapse the support 6, FIG. 7, the brace 48 is first folded under and overlying the rear wall 31, direction 101, FIG. 4. The brace may or may not abut the wall 31. This requires stretching the elastic band 58. Then the rear wall 31 is pushed toward the display 4 rear wall 14 in direction 94, FIG. 7. This folds the sidewalls 32 and 34 at foldlines 36 inwardly toward each other. The rear wall 31 is pushed further until the support 6 walls are collapsed as shown in FIGS. 6 and 8. In this state, the walls of the support 6 are either abutting or in closely spaced overlying relation. The location of the band 58 on the brace 48 and on the display 4 rear wall 14 and its length are such that the band in its stretched condition in the collapsed state can not open the support to its fully deployed state of FIG. 1. The force of the band 58 may tend to open the support from the collapsed state slightly. There is insufficient force, however, to fully deploy the support to its deployed support condition of FIG. 1 due to the relative angle of the tensile force on the member 58 imposed on the brace 48. This deployment requires a snap action.

To keep the collapsed support fully collapsed, a clip 96 may be used. The clip has a flange 98 and a tab 100. The flange 98 overlies the collapsed rear wall 31, FIG. 6, with the tab 100 inserted in side slot 102. A clip 96 is on each side of the display 4. In the alternative, an elastic band 104, FIG. 6*b*, may be used to wrap about the collapsed assembly to keep the support 6 fully collapsed. A cord (not shown) or other arrangements, in the alternative, may be used to retain the support fully collapsed. Although no retainer is essential to keep the support 6 collapsed, such a retainer is useful to preclude accidental deployment of the support.

To deploy the support 6 from the collapsed state, the rear wall 31 is merely manually lifted in a direction away from the display rear wall 14, opposite direction 94, FIG. 7. A point is reached at which the position of the brace is such and the force of the elastic band 58 is sufficient to automatically snap rotate the brace 48 direction 106, FIG. 4, from its folded collapsed state of FIG. 6 to the open deployed state of FIGS. 1–3.

The brace 48 automatically snaps into the position of FIG. 4 and stops in place as a function of the bias force on the band 58 once the wall 31 is displaced past a certain position. The brace 48 in the deployed state abuts the side walls 32 and 34 on each opposing brace edge 49, locking the side walls extended. Only when the brace is manually folded back to the brace collapsed state of FIG. 7, are the side walls now freed to fully collapse. With the brace deployed as in FIG. 4, the side walls can not fold inwardly toward each other into the collapsed state.

A stop (not shown) on the display 4 rear wall 14 may be used in the alternative to stop the brace at the locked position of FIG. 4. Thus no manual assembly of interlocking pieces as in the prior art displays is required. The tension in the member 58 creates potential energy sufficient to cause the collapsed support 6 to automatically assume the deployed state. This deployment occurs automatically with a mere finger lifting action on the rear wall 31.

It will occur to one of ordinary skill that various modifications may be made to the disclosed embodiments which are given by way of illustration and not limitation. For example triangular sidewalls of the support are not necessary. They may be other shapes such as rectangular, curved and so on. Also, while two side walls, a rear wall and a brace are disclosed, other arrangements of biased walls may be provided to support a display that has a collapsed state and an extended deployed state wherein the deployment is effected by a bias device such that the deployed support will function to support a given display. It is intended that the scope of the invention is as defined by the appended claims.

What is claimed is:

1. A collapsible display stand comprising:

an article display tray for receiving articles to be displayed; the tray having a bottom wall, a pair of opposing side walls and an end wall extending from the bottom wall, the tray having spaced slots in the bottom wall adjacent to the opposing side walls;

a collapsible display member support having at least one rear wall with opposing first edges, opposing spaced first and second side walls each hinged to the rear wall at a different one of the rear wall opposing first edges, the first and second side walls each having a medial first hinge and a second edge distal the first hinge and distal the at least one rear wall such that the first and second side walls can each selectively collapse against the at least one rear wall; and at least one tab extending from each of the first and second side walls at the second edge thereof the at least one tab being received in a different slot in the tray to releasably secure the support to the tray whereby in the collapsed state the at least one rear wall and first and second side walls are juxtaposed with at least a portion of the tray rear wall and in the extended state the tray bottom wall cooperates with the support to form a four wall support structure with the support to thereby forming a self supporting display stand.

2. The stand of claim 1 further including a brace having a collapsed state and a deployed state, the brace being hinged to the at least one rear wall and shaped and sized to abut the opposing first and second support side walls and tray bottom wall in the deployed state to stiffen the deployed side walls, the medial first hinge forming each of the first and second side walls into first and second sections, the collapsed sections of the first and second side walls each folding relative to each other at the respective medial first hinge, the collapsed sections of a side wall and the brace being juxtaposed with the at least one rear wall and tray bottom wall in the collapsed state.

3. The stand of claim 2 wherein the support first and second side walls, tabs, at least one rear wall and brace are one piece paperboard.

4. The stand of claim 2 including bias means secured to the brace and tray bottom wall for biasing the brace to the deployed state.

5. The stand of claim 4 wherein the bias means includes an elastic member secured to the brace and to the tray bottom wall for urging the support to the deployed state.

6. The stand of claim 5 wherein the bias means automatically deploys the support from a given displaced position relative to the collapsed state to the deployed state.

7. The display stand of claim 4 including means for retaining the support collapsed such that removal of the retaining means permits the support to deploy automatically.

8. The display stand of claim 7 wherein the retaining means consists of at least one of the group selected from an elastic band and a clip.

9. The stand of claim 2 wherein the at least one rear wall comprises two spaced rear walls and wherein the brace is secured to one of the two rear walls, the brace in the collapse state being positioned between and coplanar with the two spaced rear walls, the brace, rear walls, first and second side walls and tabs being one piece paper board.

10. The stand of claim 1 wherein the at least one rear wall has a finger receiving opening for permitting the support to be manually deployed from the collapsed state.

11. The stand of claim 1 wherein the tray side walls and tray bottom wall each have a support edge, the support first and second side walls and the at least one rear wall each having a further edge that is coplanar with the tray support edges and define a support plane for the tray and support.

12. The stand of claim 1 wherein the at least one rear wall comprises two spaced rear walls with the brace member hinged to a first of said rear walls and is integral and one piece with the first of said rear walls.

13. The display stand of claim 1 wherein the tabs are hook-shaped.

14. The display stand of claim 1 wherein the support walls have edges that define a support plane, the support extending from the support plane a first given length, the tray having a length greater than that of the support first given length, the tray having a first end approximately coextensive with the support plane and a second end distal the first end extending beyond the support.

15. The support of claim 14 wherein the at least one rear wall, first and second side walls, tabs and brace are one piece paper board.

16. A collapsible support for releasably receiving and supporting a tray having a bottom wall connected to a plurality of interconnected first side walls defining an article receiving chamber, the tray bottom wall having a plurality of spaced slots adjacent to an opposing pair of said first side walls, the support comprising:

at least one sheet material rear wall;

a pair of sheet material opposing second side walls each having opposing first and second edges and a medial fold line for dividing that side wall into first and second triangular sections between the side wall first and second edges, a first section of each second side wall being hinged at the second side wall first edge to the at least one rear wall at respective different opposing at least one rear wall first and second edges such that the sections of each side wall fold at its respective fold line may collapse in juxtaposed relation with the at least one rear wall; and a pair of tabs extending from each of the first and second side walls at the second edge of the first and second side walls, each tab for being received in a different slot in the tray to releasably secure the support to the tray such that in the collapsed state the first and second side wall sections are juxtaposed with the at least one rear wall and in the extended state the at least one rear wall and first and second side walls cooperate with the attached tray bottom wall to form a four wall structure to stiffen the support and form the support into a self supporting structure.

17. The support of claim 16 further including a sheet material brace having a collapsed state and an extended state, the brace being hinged to the at least one rear wall and shaped and sized to abut the opposing side walls and received tray bottom wall in the deployed state to stiffen the side walls in the deployed state, the brace being juxtaposed with the sections of each side wall and with the at least one rear wall in the collapsed state.

18. The support of claim 16 wherein the support rear wall and side walls terminate at corresponding support edges forming a support plane, the tabs and slots being arranged to support the tray so that the support edges terminate at an approximate end of the tray secured to the support.

19. A collapsible display stand comprising:

an article display tray for receiving articles to be displayed; the tray having a bottom wall, a pair of opposing side wails and an end wall extending from the bottom wall, the tray having spaced slots in the bottom wall adjacent to the opposing side walls;

a collapsible display member support having at least one rear wall with opposing first edges, opposing spaced first and second side walls each hinged to the rear wall at a different one of the rear wall opposing first edges, the first and second side walls each having a medial first hinge and a second edge distal the first hinge and distal the at least one rear wall such that the first and second side walls can each selectively collapse against the at least one rear wall; and at least one tab extending from each of the first and second side walls at the second edge thereof, the at least one tab being received in a different slot in the tray to releasably secure the support to the tray whereby in the collapsed state the at least one rear wall and first and second side walls are juxtaposed with at least a portion of the tray rear wall.

* * * * *